US007131545B1

(12) United States Patent
Grogan

(10) Patent No.: US 7,131,545 B1
(45) Date of Patent: Nov. 7, 2006

(54) GLASS RACK

(76) Inventor: Thomas A Grogan, P.O. Box 20776, Juneau, AK (US) 99802

( * ) Notice: Subject to any disclaimer, the term of this patent is extended or adjusted under 35 U.S.C. 154(b) by 83 days.

(21) Appl. No.: 10/957,987

(22) Filed: Oct. 4, 2004

Related U.S. Application Data

(60) Provisional application No. 60/509,380, filed on Oct. 6, 2003.

(51) Int. Cl.
*A47G 29/00* (2006.01)

(52) U.S. Cl. ..... 211/85.29; 211/113; 248/310; 248/311.3

(58) Field of Classification Search ..... 211/85.29, 211/74, 41.2, 60.1, 162, 86.01, 113, 59.2, 211/94.02, 75, 106, 31; D7/701, 708, 7; D6/566; 248/310, 311.3, 154; 108/25, 27, 108/28
See application file for complete search history.

(56) References Cited

U.S. PATENT DOCUMENTS

| | | | | | |
|---|---|---|---|---|---|
| 278,161 | A | | 5/1883 | McKee | |
| 647,039 | A | * | 4/1900 | Shuman | 211/31 |
| 1,088,642 | A | | 2/1914 | Wilcox | |
| 1,509,480 | A | * | 9/1924 | Parks | 211/31 |
| 1,925,540 | A | | 9/1933 | Neuschotz | |
| 3,022,899 | A | | 2/1962 | Unsworth | |
| 3,352,427 | A | * | 11/1967 | Lawrence et al. | 211/74 |
| 3,491,893 | A | | 1/1970 | Morris | |
| 3,650,502 | A | * | 3/1972 | Langhi | 248/220.41 |
| 4,905,949 | A | | 3/1990 | Cosgrove | |
| 5,613,614 | A | * | 3/1997 | Richardson | 211/89.01 |
| 5,632,427 | A | * | 5/1997 | Gattuso et al. | 224/309 |
| 6,631,812 | B1 | | 10/2003 | Ruiz | |
| 6,843,381 | B1 | * | 1/2005 | Wu | 211/85.29 |

FOREIGN PATENT DOCUMENTS

| | | |
|---|---|---|
| GB | 2221149 | 1/1990 |
| GB | 2228404 | 8/1990 |

* cited by examiner

*Primary Examiner*—Richard E. Chilcot, Jr.
*Assistant Examiner*—Lindsay M. Maguire
(74) *Attorney, Agent, or Firm*—Michael I Kroll

(57) ABSTRACT

Apparatus for a rack for stemware includes a main base plate having a device for engaging and retaining the positioning of a first and second portion of an article to be held. A pair of straps are predeterminedly fastened to the base whereby a plurality of glasses having a base can be inserted under opposing portions of the straps whereby the plurality of glasses are prevented from movement. The apparatus also provides for an additional method of fastening the straps by providing a plurality of row of throughbores whereby the straps can be woven through the holes in a number of methods with the end result being that stemware-like glasses can be retained by sliding one side of the glass base under one of the straps and the other side of the glass base under the opposing strap.

15 Claims, 12 Drawing Sheets

GLASS RACK

RELATED APPLICATIONS

This application is subject to U.S. provisional application Ser. No. 60/509,380, filed 6 Oct. 2003. Please incorporate by reference all information in said provisional application into this instant application.

BACKGROUND OF THE INVENTION

1. Field of the Invention

The present invention relates generally to support racks and, more specifically, to a rack for stemware comprised of a base plate having means for engaging and retaining the positioning of a first and second portion of an article to be held.

In the preferred embodiment, a pair of straps are predeterminedly fastened to the base whereby a plurality of glasses having a base can be inserted under opposing portions of the straps whereby said plurality of glasses are prevented from movement.

The present invention also provides for an additional method of fastening the straps by providing a plurality of row of throughbores whereby the straps can be woven through the holes in a number of methods with the end result being that stemware-like glasses can be retained by sliding one side of the glass base under one of the straps and the other side of the glass under the opposing strap.

2. Description of the Prior Art

There are other racks designed for article supporting. Typical of these is U.S. Pat. No. 278,161 issued to McKee on May 22, 1883.

Another patent was issued to Wilcox on Feb. 24, 1914 as U.S. Pat. No. 1,088,642. Yet another U.S. Pat. No. 1,925,540 was issued to Neuschotz on Sep. 5, 1933 and still yet another was issued on Feb. 27, 1962 to Unsworth as U.S. Pat. No. 3,022,899.

Another patent was issued to Morris on Jan. 27, 1970 as U.S. Pat. No. 3,491,893. Yet another U.S. Pat. No. 4,905,949 was issued to Cosgrove on Mar. 6, 1990. Another was issued to Ruiz on Oct. 14, 2003 as U.S. Pat. No. 6,631,812 and still yet another was issued on Jan. 31, 1990 to Collins as U.K. Patent No. GB2221149 and yet another U.K. Patent No. GB2228404 was issued on Aug. 29, 1990 to Fridjhon.

U.S. Pat. No. 278,161

Inventor: Frank L. McKee

Issued: May 22, 1883

A rack for graduated glass measures and other articles, constructed substantially as herein shown and described, and consisting of plate, having flanged cleats attached to it, and provided at its inner edge with a stop-flange, as set forth.

U.S. Pat. No. 1,088,642

Inventor: Frank A. Wilcox

Issued: Feb. 24, 1914

A milk test bottle rack, comprising a base member provided with sockets adapted to receive the lower ends of tubes or bottles, a follower board having registering openings adapted to receive the necks of said tubes or bottles, upstanding posts carried by the base member, and means for locking the follower board in position, said post being extended beyond the open ends of the said tubes or bottles so as to support the same free from a drain board, when the device is in an inverted position.

U.S. Pat. No. 1,925,540

Inventor: Robert A. Neuschotz

Issued: Sep. 5, 1933

A device for supporting a receptacle having a stem and a base, on a support, comprising a plate, a pair of spaced, resilient arms extending from said plate, said arms being disposed adjacent to said plate and adapted to receive the base of said receptacle between said arms and said plate for pressing said base against said plate, with the stem disposed between said arms, said arms having means adapted to engage the rim of the base of the said receptacle to retain said receptacle from slipping out, and stop means on said arms adapted to contact the stem of said receptacle to limit movement of said receptacle in a direction away from the free ends of said arms.

U.S. Pat. No. 3,022,899

Inventor: Alan Rene Unsworth

Issued: Feb. 27, 1962

A rack structure for supporting win glasses and the like in pendant position comprising a plurality of brackets each consisting of a cross-piece aperture to receive securing screws and having two depending leg pieces with the inwardly facing surfaces thereof being formed slots, pairs of opposed rail members supported by said brackets in end to end spaced aligned disposition with each end of each rail having a part engaged within the slot of the adjacent bracket of said brackets and each of said rails having one down-turned terminal end disposed adjacent to a straight end of the next succeeding rail to provide a downwardly inclined entry and exit opening whereby the base of a wine glass can pass therethrough when the wine glass is held at the appropriate angle.

U.S. Pat. No. 3,491,893

Inventor: Charles L. Morris

Issued: Jan. 27, 1970

A bracket for use on a hinged door to support stemware or the like, said bracket comprising a generally planar shelf having a first edge with a flange for abutting the inside of the door, means for mounting said shelf to the door, an outer edge of said shelf which is arcuate and clears the door opening when the door is moved between its closed and its open position, said shelf having a second edge which cooperates with said first edge to form a corner of said shelf adjacent the hinged edge of the door, said shelf having at least one slot opening outwardly to said arcuate edge and extending generally toward said corner for receiving inverted stemware.

U.S. Pat. No. 4,905,949

Inventor: James H. Cosgrove

Issued: Mar. 6, 1990

A device for releasably supporting a plurality of objects such as cans and which allows the selective removal or replacement of any one of the objects without disturbing the others releasably supported thereby.

U.S. Pat. No. 6.631,812

Inventor: Emillio Ruiz

Issued: Oct. 14, 2003

A stemware suspender includes a generally rectangular frame; and a support member extending from the frame, the support member being sized, shaped and positioned so as to define an opening for receiving a stem of a piece of stemware, the support member being angled with respect to the frame so that a base of the piece of stemware is centered between opposite sides of the frame when the base is supported in the suspender. A plurality of the stemware suspenders may be mounted on a base plate, to assist in installation of multiple suspenders. A kit may include appropriate hardware for mounting the stemware suspenders to a surface. A method for efficiently utilizing space by mounting the stemware supsenders individually or when associated with base plates so that stemware pieces placed in suspenders on facing surfaces are disposed adjacent to one another.

U.K. Patent Number GB2221149

Inventor: Barry William Collins

Issued: Jan. 31, 1990

A racking system has end frames 1 and 3 forming a means of support for the bases of bottles of various sizes, to allow the alternate stacking of bottles from either end with necks supported on frame 2 assembly, which has openings of sufficient size to accommodate the necks of these bottles without allowing excessive horizontal movement. By using different combinations of end and central supports bottles may be stacked horizontally or inclined downwards or upwards. Individual bottles are identifiable.

U.K. Patent Number GB2228404

Inventor: Michael Fridjhon

Issued: Aug. 29, 1990

The invention provides a wine rack comprising a pair of planar support members each defining a plurality of cradle formations for receiving a wine bottle or the like, and one or more brace elements which are adapted collapsibly to secure the support members to one another in spaced relationship with cradle formations aligning with one another so that in use these are capable of supporting a wine bottle in a horizontal or tilted attitude.

While thes racks may be suitable for purposes for which they were designed, they would not be as suitable for the purposes of the present invention, as hereinafter described.

SUMMARY OF THE PRESENT INVENTION

The present invention discloses a rack for stemware comprised of a main base plate having means for engaging and retaining the positioning of a first and second portion of an article to be held. In the preferred embodiment, a pair of straps are predeterminedly fastened to the base whereby a plurality of glasses having a base can be inserted under opposing portions of the straps whereby the plurality of glasses are prevented from movement. The present invention also provides for an additional method of fastening the straps by providing a plurality of row of throughbores whereby the straps can be woven through the holes in a number of methods with the end result being that stemware-like glasses can be retained by sliding one side of the glass base under one of the straps and the other side of the glass base under the opposing strap.

A primary object of the present invention is to provide a rack that prevents movement of the article being held.

Another object of the present invention is to provide a rack that can be used to store glasses in moving vehicles, such as Recreational Vehicles and Boats.

Yet another object of the present invention is to provide a rack comprised of a planar surface forming a base having a plurality of spaced apart straps predeterminedly fastened to the base providing means for engaging and retaining the selective positioning of a glass therein.

Still yet another object of the present invention is to provide a rack having a base with a plurality of linearly space throughbores therein whereby the strap can be woven therethrough.

Another object of the present invention is to provide a rack having a base with a plurality of pegs whereby the strap can be inserted into and out of the same throughbore with a peg positioned within the looped end.

Additional objects of the present invention will appear as the description proceeds.

The present invention overcomes the shortcomings of the prior art by providing a rack for stemware comprised of a base plate having means for engaging and retaining the positioning of a first and second portion of an article to be held. In the preferred embodiment, a pair of straps are predeterminedly fastened to the base whereby a plurality of glasses having a base can be inserted under opposing portions of the straps whereby said plurality of glasses are prevented from movement. The present invention also provides for an additional method of fastening the straps by providing a plurality of row of throughbores whereby the straps can be woven through the holes in a number of methods with the end result being that stemware-like glasses can be retained by sliding one side of the glass base under one of the straps and the other side of the glass under the opposing strap.

The foregoing and other bojects and advantages will appear from the description to follow. In the description reference is made to the accompanying drawings, which form a part hereof, and in which is shown by way of illustration-specific embodiments in which the invention may be practiced. These embodiments will be described in sufficient detail to enable those skilled in the art to practice the invention, and is to be understood that other embodiments may be utilized and that structural changes may be made without departing form the scope of the invention. In the accompanying drawings, the like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying in which.

LIST OF REFERENCE NUMERALS

Figure 1:
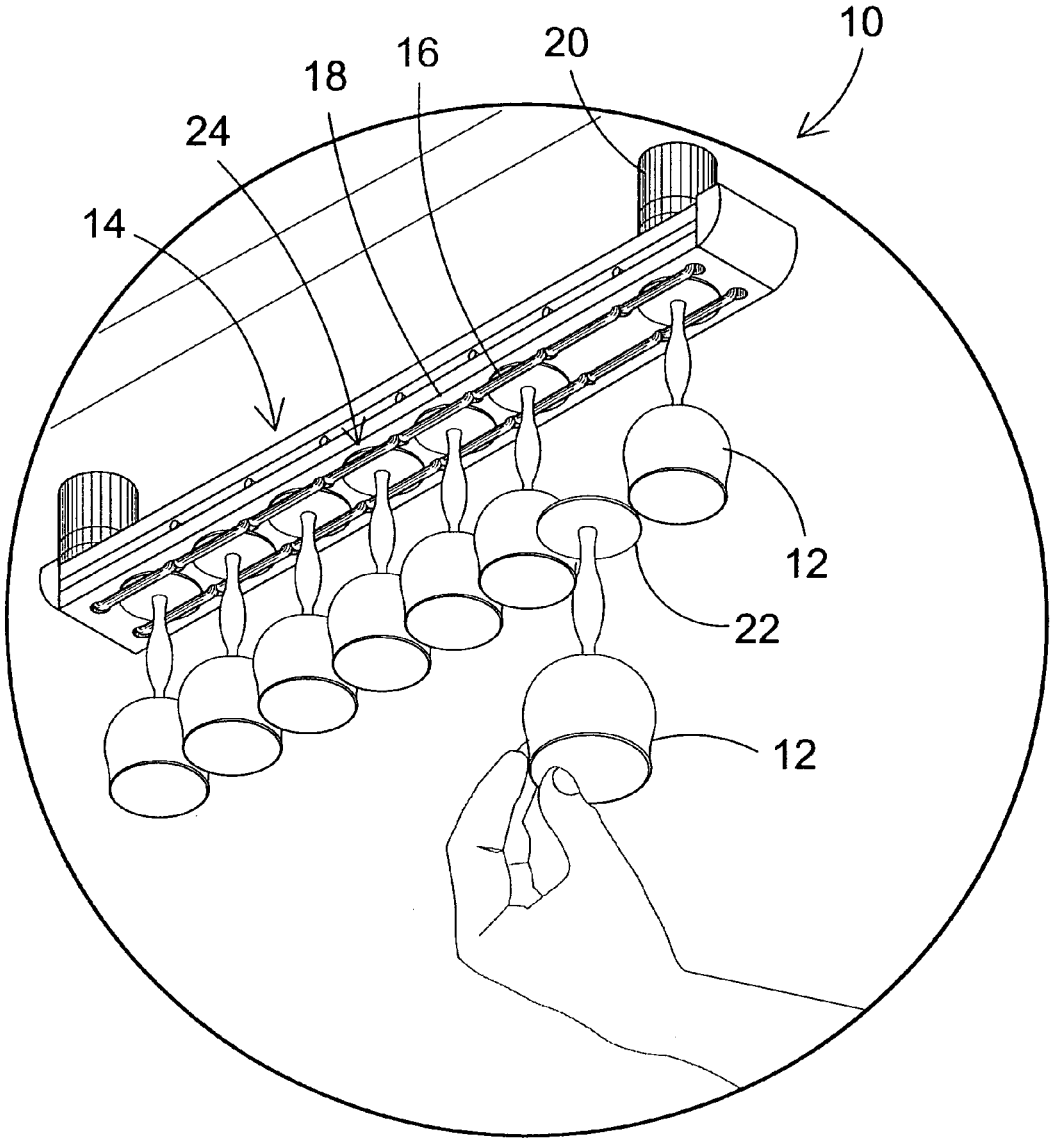
FIG. 1 is an illustrative view of the present invention in use.

With regard to reference numerals used, the following numbering is used throughout the drawings.

10 present invention
12 glass
14 backer plate
16 cord
18 hold
20 leg
22 base of glass
24 main plate
26 pins
28 shim
30 trim
32 ceiling
34 staples
36 straight
38 "L"
40 "U"
42 circle
44 oval

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 discloses a glass rack designed for boats and recreation vehicles, that holds the glass 12 in a static position regardless of the movement of the vehicle or boat. The glass rack 10 consists of a flat board or main plate 24 having selectively positioned holes 18 with elastic shock cord 16 woven within the holes with metal pins that hold the cord in place on the back side of the rack. Legs 20 and shims are provided to level the rack when mounting. A backer plate or board 14 is provided to seclude the back board components. The foot or base portion 22 of a glass 12 is inserted between two of the shock cord 16 rows and is held tightly against the main board 24 by the shock cords. The glass rack can be provided in any size and can accommodate wine glasses or any type of footed glasses 12.

Figure 2:
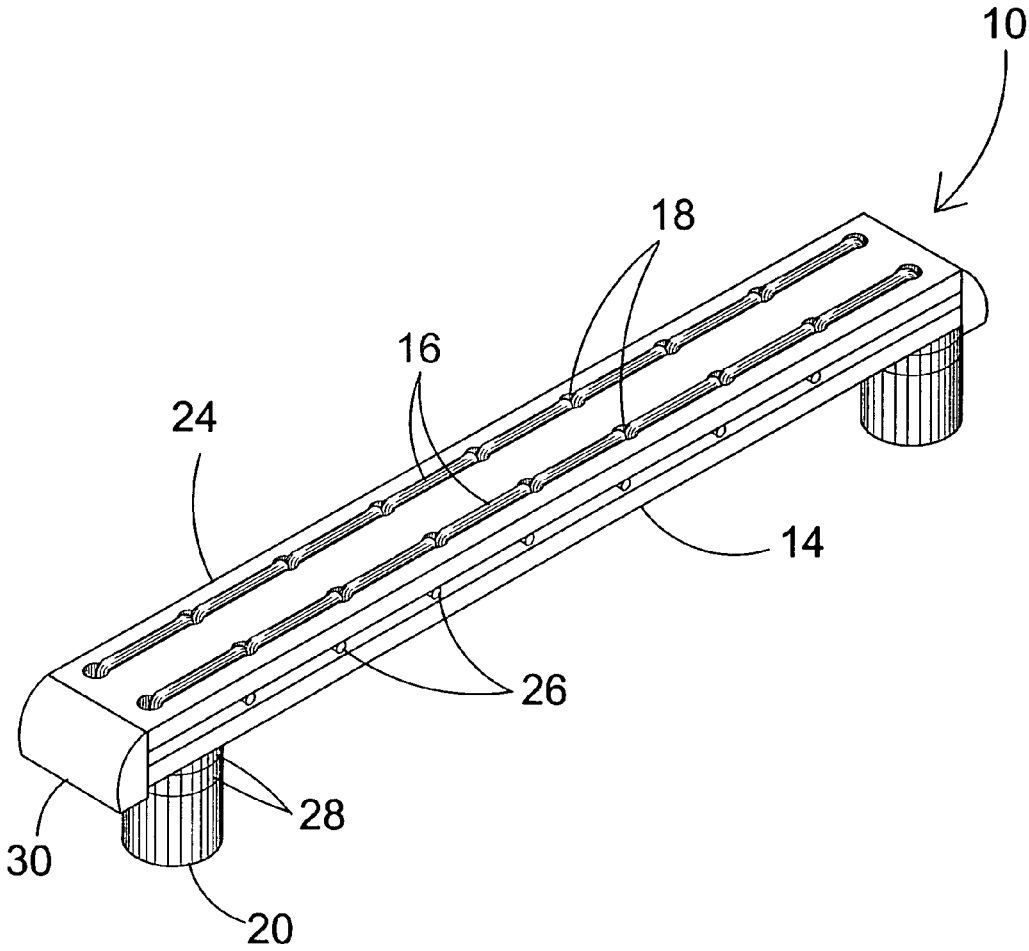
FIG. 2 is a perspective view of the present invention.

Turning to FIG. 2, shown therein is a perspective view of the present invention 10. Shown is the present invention 10 disclosing a glass rack designed for boats and recreation vehicles that holds the glass in a static position regardless of the movement of the vehicle or boat. The glass rack 10 consists of a flat board main plate 24 having selectively positioned holes 18 with shock cord 16 woven within the holes with metal pins 26 that hold the cord in place on the back side of the plate. Legs 20 and shims 28 are provided to level the rack when mounting. A backer board 14 is provided to seclude the back board components. The foot or base portion of a glass is inserted between two of the shock cord 16 rows and is held tightly against the main board 24 by the shock cords. The glass rack can be provided in any size and can accommodate wine glasses or any type of footed glasses. Trim 30 is also shown.

Figure 3:
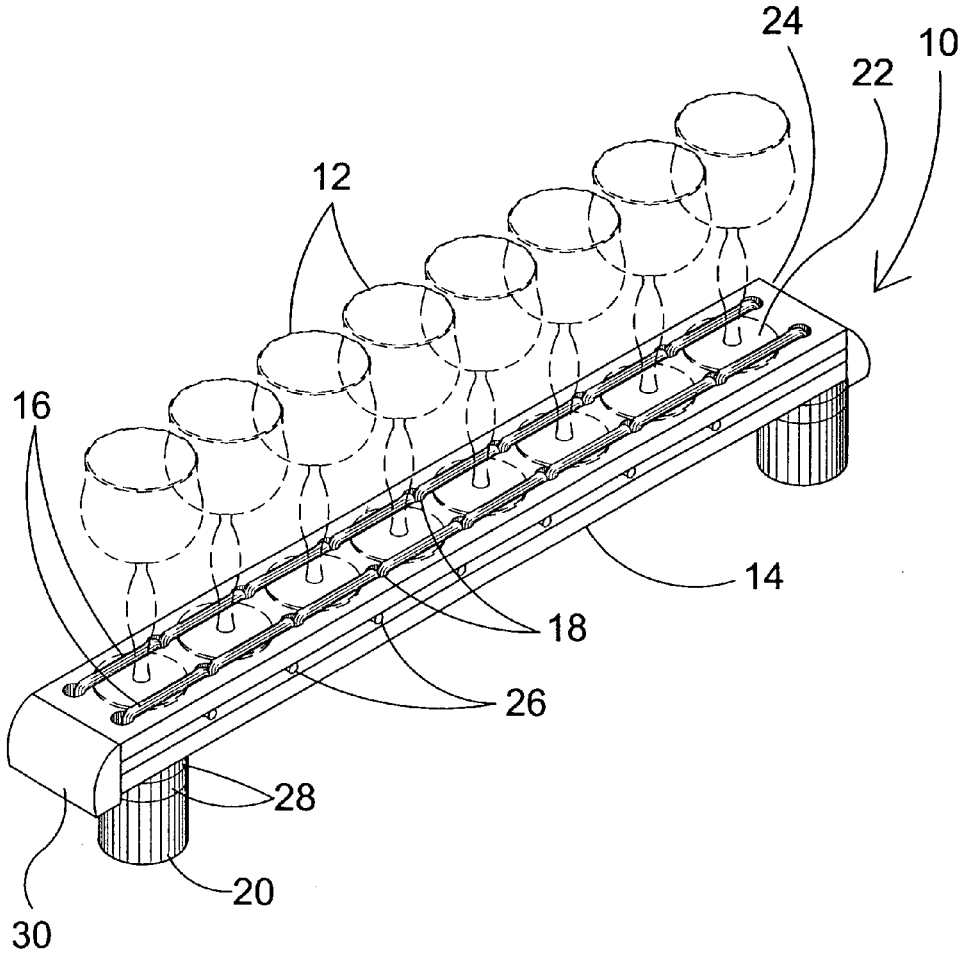
FIG. 3 is a perspective view of the present invention.

Turning to FIG. 3, shown therein is a perspective view of the present invention 10. Shown is the present invention 10 disclosing a glass rack designed for boats and recreation vehicles that holds the glass 12 in a static position regardless of the movement of the vehicle or boat. The glass rack 10 consists of a main flat board 24 having selectively positioned holes 18 with two rows of shock cord 16 woven within the holes 18 with metal pins 26 that hold the cord in place on the back side of the rack. Legs 20 and shims 28 are provided to level the rack when mounting. A backer board 14 is provided to seclude the back board components. The foot or base portion 22 of a glass is inserted between two of the shock cord 16 rows and is held tightly against the main board 24 by the shock cords. The glass rack can be provided in any size and can accommodate wine glasses or any type of footed glasses. Trim 30 is also shown.

Figure 4:
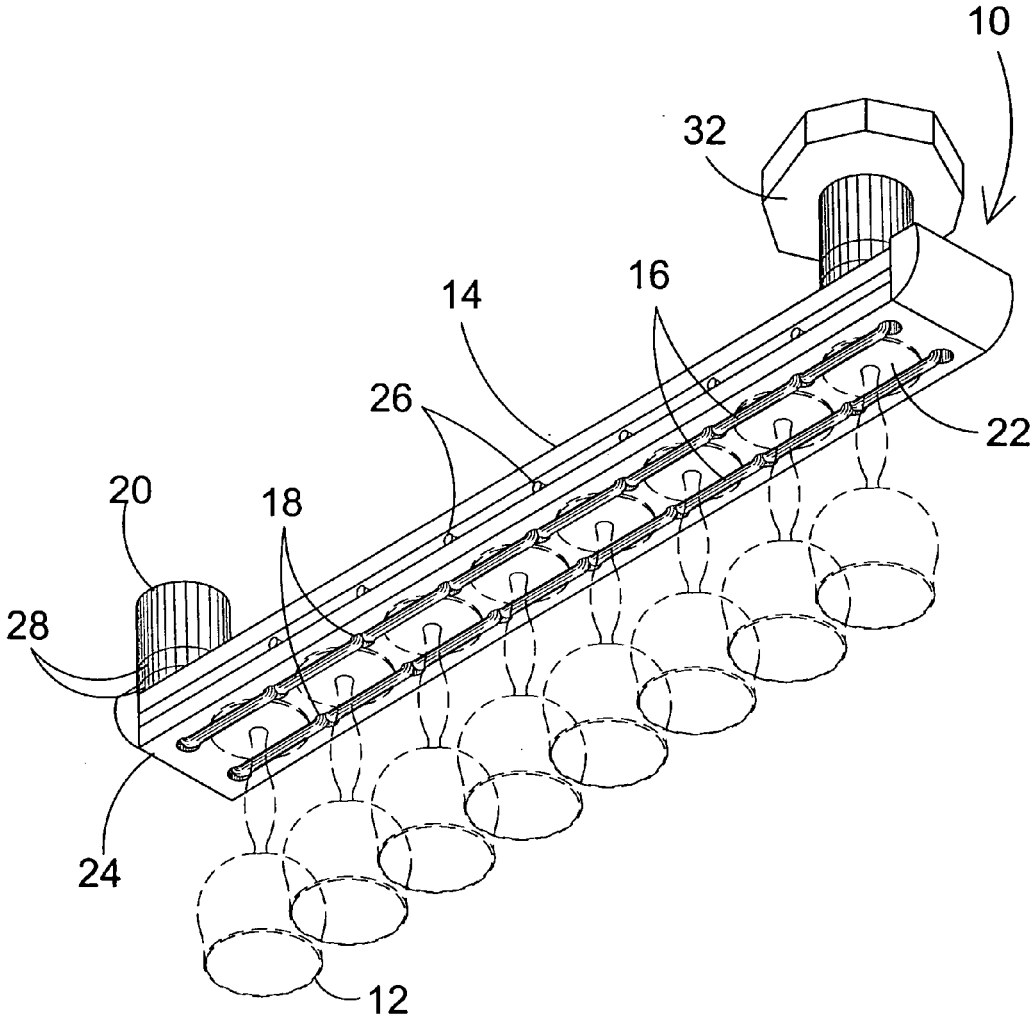
FIG. 4 is a perspective view of the present invention looking up (if ceiling mounted).

Turning to FIG. 4, shown therein is a perspective view of the present invention 10 looking up (if ceiling 32 mounted). Shown is the present invention 10 disclosing a glass rack designed for boats and recreation vehicles that holds the glass 12 in a static position regardless of the movement of the vehicle or boat. The glass rack 10 consists of a main flat board 24 having selectively positioned holes 18 with shock cord 16 woven within the holes with metal pins 26 that hold the cord in place on the back side of the rack. Legs 20 and shims 28 are provided to level the rack when mounting. A backer board 14 is provided to seclude the back board components. The foot or base portion 22 of a glass is inserted between two of the shock cord 16 rows and is held tightly against the main board 24 by the shock cords. The glass rack can be provided in any size and can accommodate wine glasses or any type of footed glasses.

Figure 5:
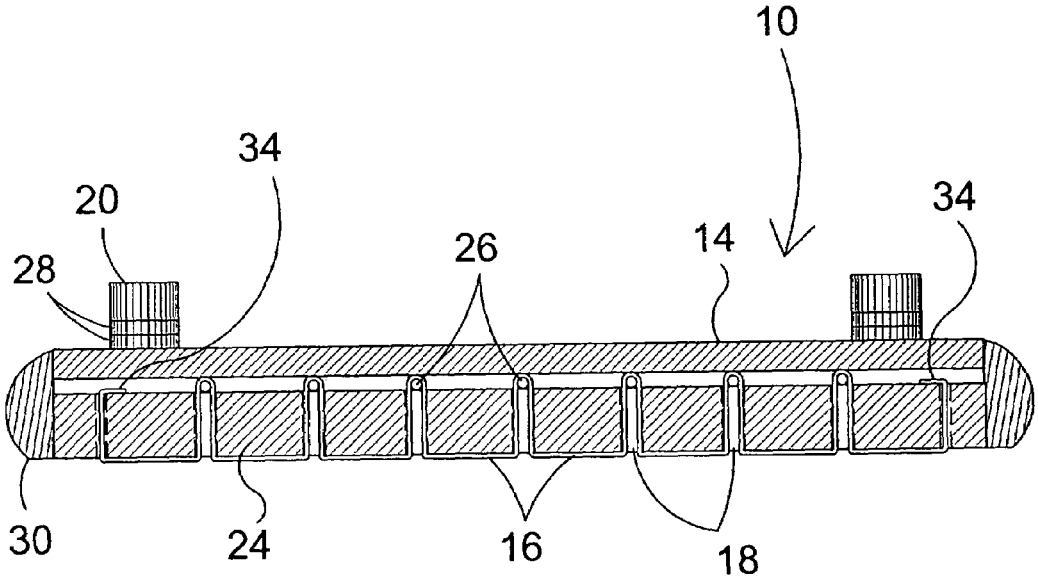
FIG. 5 is a sectional view of the present invention.

Turning to FIG. 5, shown therein is a sectional view of the present invention 10. Shown is the present invention 10 disclosing a glass rack designed for boats and recreation vehicles that holds the glass in a static position regardless of the movement of the vehicle or boat. The glass rack consists of a main flat board 24 having selectively positioned holes 18 with shock cord 16 woven within the holes with metal pins 26 that hold the cord in place on the back side of the rack. Legs 20 and shims 28 are provided to level the rack when mounting. A backer board 14 is provided to seclude the back board components. The foot or base portion of a glass is inserted between two of the shock cord 16 rows and is held tightly against the main board 24 by the shock cords. The glass rack can be provided in any size and can accommodate wine glasses or any type of footed glasses. Trim 30 and staples 34 are also shown.

Figure 6:
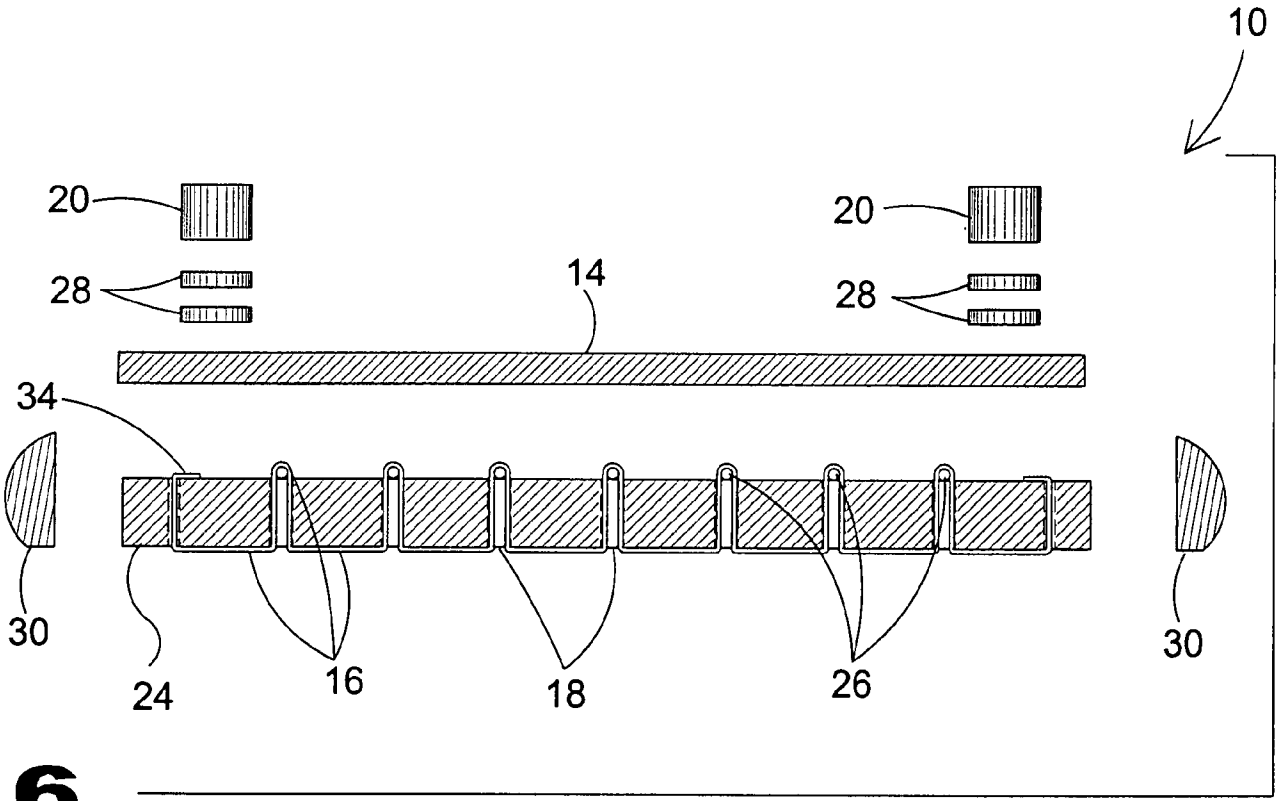
FIG. 6 is an exploded sectional view of the present invention.

Turning to FIG. 6, shown therein is an exploded sectional view of the present invention 10. Shown is the present invention 10 disclosing a glass rack designed for boats and recreation vehicles that holds the glass in a static position regardless of the movement of the vehicle or boat. The glass rack consists of a flat board 24 having selectively positioned holes 18 with shock cord 16 woven within the holes with metal pins 26 that hold the cord in place on the back side of the rack. Legs 20 and shims 28 are provided to level the rack when mounting. A cover or backer board 14 is provided to seclude the back board components. The foot or base portion of a glass is inserted between two of the shock cord 16 rows and is held tightly against the main board 24 by the shock cords. The glass rack 10 can be provided in any size and can accommodate wine glasses or any type of footed glasses. Trim 30 and staples 34 are also shown.

Figure 7:
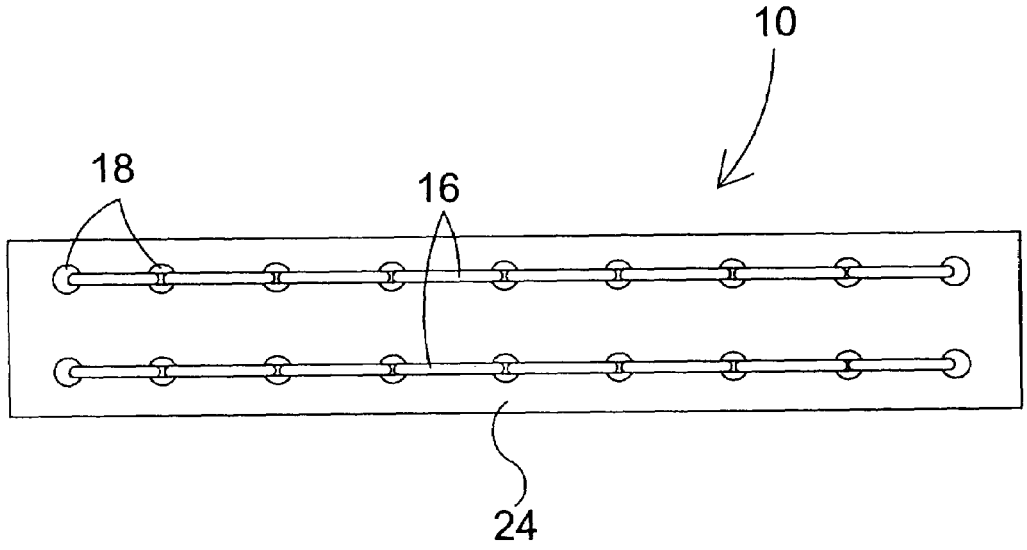
FIG. 7 is a top view of the main board of the present invention.

Turning to FIG. 7, shown therein is a top view of the main board 24 of the present invention 10. Shown is the present invention 10 disclosing a glass rack designed for boats and recreation vehicles that holds the glass in a static position regardless of the movement of the vehicle or boat. The glass rack consists of a main flat board 24 being of wood, glass, metal or other material having selectively positioned holes 18 with shock cord 16, stretchable cord, spring, elastic or leather material woven within the holes with metal pins that hold the cord in place on the back side of the rack. Legs and shims are provided to level the rack when mounting. A backer board is provided to seclude the back board components. The foot or base portion of a glass is inserted between two of the shock cord 16 rows and is held tightly against the main board by the shock cords. The glass rack can be provided in any size and can accommodate wine glasses or any type of footed glasses.

Figure 8:
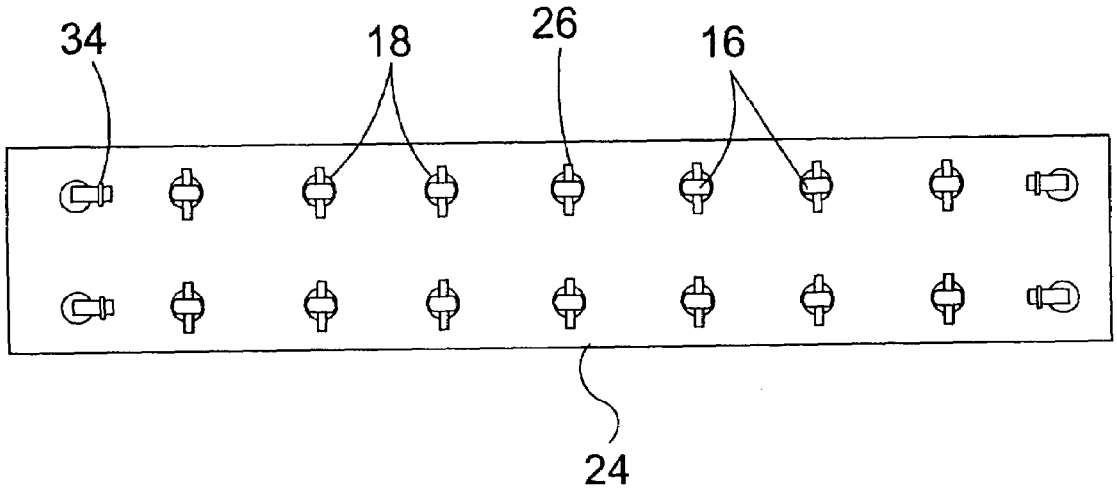
FIG. 8 is a bottom view of the main board of the present invention.

Turning to FIG. 8, shown therein is a bottom view of the main board 24 of the present invention 10. Shown is the present invention 10 disclosing a glass rack designed for boats and recreation vehicles that holds the glass in a static position regardless of the movement of the vehicle or boat. The glass rack consists of a main flat board 24 having selectively positioned holes 18 with shock cord 16 woven within the holes with metal pins 26 that hold the cord in place on the back side of the rack. Legs and shims are provided to level the rack when mounting. A backer board is provided to seclude the back board components. The foot or base portion of a glass is inserted between two of the shock cord 16 rows and is held tightly against the main board 24 by the shock cords. The glass rack can be provided in any size and can accommodate wine glasses or any type of footed glasses. Staple 34 is also shown.

Figure 9:
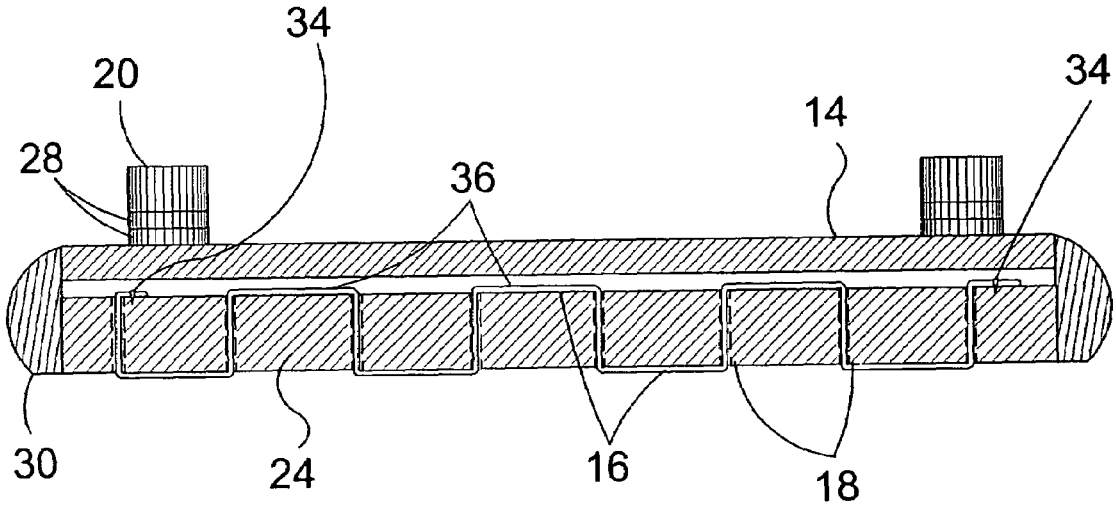
FIG. 9 is a sectional view of the present invention with cord woven through holes.

Turning to FIG. 9, shown therein is a sectional view of the present invention 10 with cord 16 woven through holes 18. Shown is the present invention 10 disclosing a glass rack designed for boats and recreation vehicles that holds the glass in a static position regardless of the movement of the vehicle or boat. The glass rack can be provided in any size or shape to accommodate specific needs or tastes. The cord 18 portion of the device is used to hold the glass in place and could be shock cord, bungee cord, elastic, rubber, leather or any other stretchy material and can be fastened to the rack in a plurality of ways such as holes and pins or woven or looped round at 36 through holes 18 or stapled at 34, tacked or nailed directly to the surface of the rack. The rack can also be designed to attach under a hanging cabinet. Other previously disclosed elements are also shown.

Figure 10:
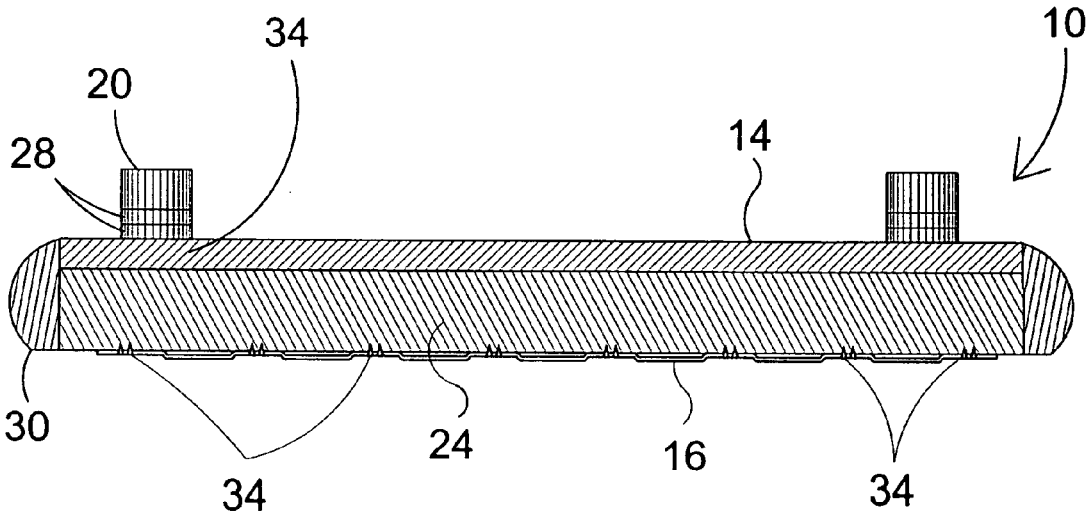
FIG. 10 is a sectional view of the present invention with cord stapled to board.

Turning to FIG. 10, shown therein is a sectional view of the present invention 10 with cord 16 stapled at 34 to board 24. Shown is the present invention 10 disclosing a glass rack designed for boats and recreation vehicles that holds the glass in a static position regardless of the movement of the vehicle or boat. The glass rack can be provided in any size or shape to accommodate specific needs or tastes. The cord 16 portion of the device is used to hold the glass in place and could be shock cord, bungee cord, elastic, rubber, leather or any other stretchy material and can be fastened to the rack in a plurality of ways such as holes and pins, woven through holes or stapled at 34, tacked or nailed directly to the surface of the rack. The rack can also be designed to attach under a hanging cabinet. Other previously disclosed elements are also shown.

Figure 11:
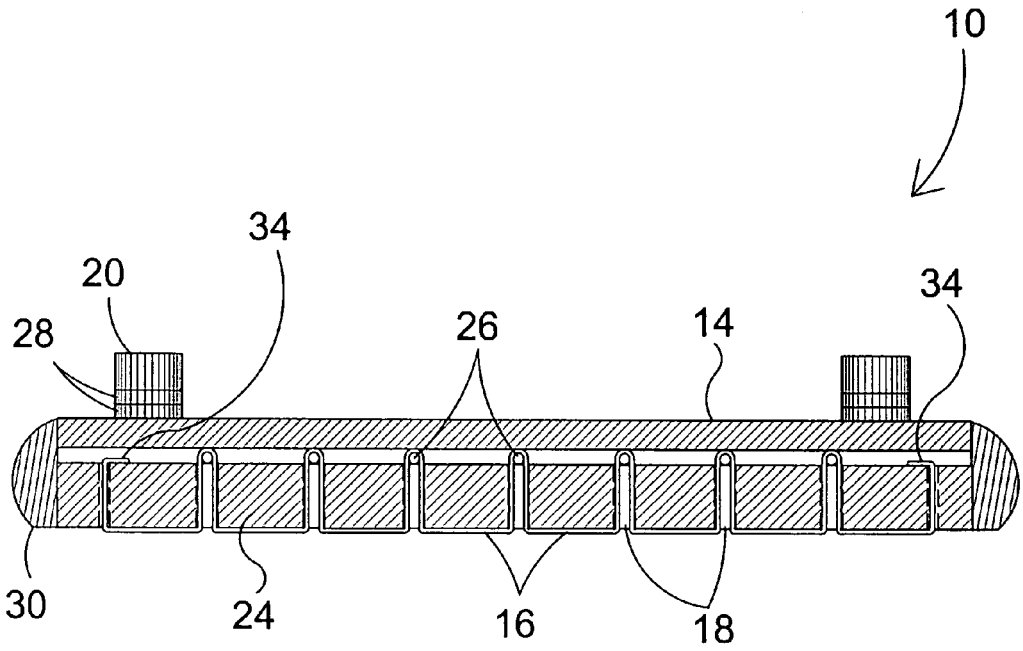
FIG. 11 is a sectional view of the present invention with cord stapled and looped through holes and over pins.

Turning to FIG. 11, shown therin is a sectional view of the present invention 10 with cord 16 stapled at 34 and looped through holes 18 and over pins 26. Shown is the present invention 10 disclosing a glass rack designed for boats and recreation vehicles that holds the glass in a static position regardless of the movement of the vehicle or boat. The glass rack can be provided in any size of shape to accommodate specific needs or tastes. The cord 16 portion of the device is used to hold the glass in place and could be shock cord, bungee cord, elastic, rubber, leather or any other stretchy material and can be fastened to the rack in a plurality of ways such as holes and pins, woven through holes or stapled at 34, tacked or nailed directly to the surface of the rack. The rack can also be designed to attach under a hanging cabinet. Other previously disclosed elements are also shown.

Figure 12:
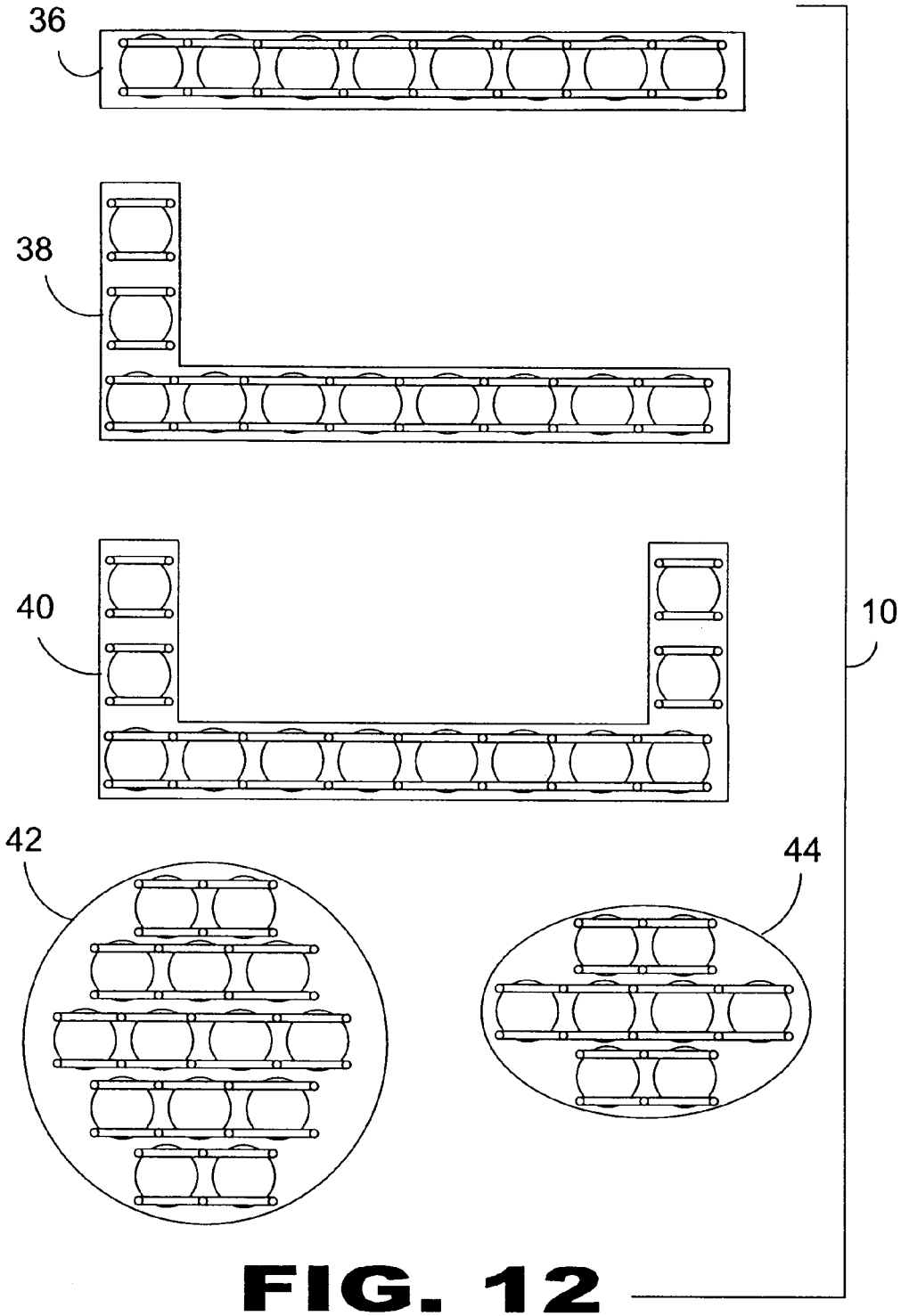
FIG. 12 is a top view of the present invention having various shapes.

Turning to FIG. 12, shown therein is a top view of the present invention 10 having various shapes. Shown is the present invention 10 having different shapes. The glass rack of the present invention 10 can be designed to fit any area having cords fastened to the rack in a plurality of ways. The present invention 10 can be shaped in a straight line 36, "L" 38, "U" 40, circle 42 or oval 44.

I claim:

1. An apparatus for suspending glasses, comprising:

a) a main plate having first and second opposing ends, a top side and a bottom side, and first and second edges, said main plate having a plurality of holes therein, wherein said holes are spaced apart in a first and second row disposed adjacent said first and second edges, respectively, of said main plate, wherein each hole in said first row corresponds to each hole in said second row, wherein said first and second row of holes extend substantially from said first end to said second end of said main plate;

b) a first and second elastic cord having first and second ends adapted for attachment longitudinally along said first and second row of holes, wherein a first row of elastic cord is disposed parallel to a second row of elastic cord so that one side of a base of a glass can be placed under said first row of elastic cord and a second side of a base of a glass can be placed under said second row of elastic cord;

c) a backer plate adapted for attachment to said main plate, said backer plate having first and second opposing ends, a top side and a bottom side, and first and second ends being complementarily shaped as said main plate, wherein said bottom side of said backer plate is disposed adjacent said top side of said main plate;

d) first and second legs, wherein said first leg is disposed on said first end of said top side of said backer plate and said second leg is disposed on said second end of said top side of said backer plate, wherein each of said first and second legs has first and second ends so that said first end of each of said first and second legs can be attached to a ceiling and said second end of each of said first and second legs can be attached to said top side of said backer plate to permit the apparatus to be attached to a ceiling so that the glasses are suspended in the apparatus; and e) at least one shim being disposed between said first and second leg and said backer plate, wherein the length of said first and second legs can be adjusted and wherein the length of said first and second legs can be adjusted.

2. The apparatus of claim 1, further comprising first and second pieces of trim being attached to said first and second ends of said main plate and said backer plate, wherein said first and second pieces of trim are disposed on said first and second ends, respectively, of said main plate and said backer plate so that said main plate is attached to said backer plate.

3. The apparatus of claim 2, wherein said first and second row of elastic cord is looped into each hole of said first and second row of holes, respectively, so as to form a loop disposed between said main plate and said backer plate, wherein a pin is placed in each of said loops so as to attach said first and second row of elastic cord to said main plate, wherein said first and second ends of each of said first and second row of elastic cord is attached to said top side of said main plate using at least one staple.

4. The apparatus of claim 2, wherein said first and second row of elastic cord is woven through said first and second row of holes so that said first and second row of elastic cord is attached to said main plate, wherein said first and second ends of each of said first and second row of elastic cord is attached to said top side of said main plate using at least one staple.

5. The apparatus of claim 4, wherein the apparatus is straight.

6. The apparatus of claim 4, wherein the apparatus is shaped like an "L".

7. The apparatus of claim 4, wherein the apparatus is shaped like a "U".

8. The apparatus of claim 4, wherein the apparatus is shaped like a circle.

9. The apparatus of claim 4, wherein the apparatus is shaped like an oval.

10. The apparatus of claim 1, wherein said first and second row of elastic cord is attached to said bottom side of said main plate by a plurality of staples spaced apart along said first and second row of elastic cord.

11. The apparatus of claim 10, wherein the apparatus is straight.

12. The apparatus of claim 11, wherein the apparatus is shaped like an "L".

13. The apparatus of claim 12, wherein the apparatus is shaped like a "U".

14. The apparatus of claim 13, wherein the apparatus is shaped like a circle.

15. The apparatus of claim 14, wherein the apparatus is shaped like an oval.

* * * * *